United States Patent [19]

Boyadjieff

[11] 3,961,399

[45] June 8, 1976

[54] POWER SLIP UNIT

[75] Inventor: George I. Boyadjieff, Anaheim, Calif.

[73] Assignee: Varco International, Inc., Orange, Calif.

[22] Filed: Feb. 18, 1975

[21] Appl. No.: 550,776

[52] U.S. Cl. ..... 24/263 DG

[51] Int. Cl.[2] ..... E21B 3/04

[58] Field of Search ..... 294/102 A, 90, 91; 24/249 HA, 249 DP, 263 DG, 263 DA, 263 D, 263 DS, 263 DT, 263 HA, 263 DM, 263 KC, 263 KH, 263 DJ, 263 DK, 263 CA, 263 DQ, 263 DN, 263 DH

[56] References Cited

UNITED STATES PATENTS

| | | | |
|---|---|---|---|
| 1,179,500 | 4/1916 | Brown | 24/249 DP |
| 1,644,470 | 10/1927 | Greve | 24/263 DQ UX |
| 1,659,783 | 2/1928 | Pearce | 24/263 HA |
| 2,034,101 | 3/1936 | Howard et al. | 24/263 DG X |
| 2,570,039 | 10/1951 | Stone | 24/263 DG |
| 2,607,098 | 8/1952 | Wilson | 24/263 D |
| 2,641,816 | 6/1953 | Liljestrand | 24/263 DG |
| 2,684,166 | 7/1954 | De Jarnett | 294/90X |
| 3,514,822 | 6/1970 | Guier | 24/263 DG |

*Primary Examiner*—Donald A. Griffin
*Attorney, Agent, or Firm*—William P. Green

[57] ABSTRACT

A power slip for supporting a well pipe, including a plurality of downwardly tapering slips adapted to be wedged against a pipe by engagement with a slip bowl, with the slips being mounted for movement between an active position about the pipe and a retracted position offset to a side of the pipe, and with the mechanism including power operated means for clamping the slips about the pipe independently of the camming action of the slip bowl in a relation enabling the slips to be moved into and out of the bowl by movement of the pipe.

26 Claims, 12 Drawing Figures

POWER SLIP UNIT

BACKGROUND OF THE INVENTION

This invention relates to improved power slip mechanisms for facilitating the handling of well pipe.

During the drilling of a well, there are various situations in which it becomes desirable to temporarily support the weight of the drill string by a set of tapered slips received within a tapered slip bowl while an upper joint or stand of pipe, or a kelly, is being connected to or disconnected from the string. To speed the setting and release of such slips, there have been devised power slip units in which a number of slips have been power actuable upwardly and downwardly relative to a coacting slip bowl, to move the slips into and out of engagement with the tapering camming surface of the bowl. In some instances, the slip assembly has also been mounted to swing laterally to a location at a side of the well pipe when not in use. As examples, certain of the prior power slip arrangements are shown in U.S. Pat. Nos. 2,939,683, 3,210,821, 3,270,389 and 3,457,605.

SUMMARY OF THE INVENTION

A major purpose of the present invention is to provide an improved power slip device which is considerably simpler than the prior power slips of which I am aware, and yet which in spite of that simplicity is capable of being set and released more efficiently than prior devices with respect to the expenditure of rig time, so that the overall operation of making or breaking a particular threaded connection can be performed more rapidly. Further, the entire slip assembly is more easily shiftable to a retracted position at the side of the pipe to completely avoid any interference with other equipment on the well when the slips are not in use.

These advantages are achieved in large part by formation of the apparatus in a manner enabling the slips to be moved vertically into and out of the slip bowl by movement of the well pipe itself, through actuation of the pipe raising and lowering mechanism of the rig, and without the necessity for provision of an additional power unit or units in the slip device for raising and lowering the slips. Preferably, the movements of the well pipe which are relied on for setting and releasing the slips are movements which are normally made by the pipe in the conventional processes of making and breaking threaded connections, regardless of what type of slip mechanism is employed. Thus, rig time is saved by utilizing more efficiently time already required for shifting the pipe during a connecting or disconnecting operation, and eliminating the necessity for use of a different interval of time to actuate the slips upwardly or downwardly by other means.

Structurally, the apparatus of the invention includes a slip assembly which is adapted to be clamped about and inwardly against a well pipe in a relation locking the slips at a fixed location on the pipe and against relative axial movement. Powered means are provided for urging the slips to this clamping condition. After the slips have been clamped on the pipe in this way, the pipe may be lowered sufficiently to bring the carried slips into engagement with the tapering cam surface of a slip bowl, so that the pipe may thereafter be supported from the bowl by the slips. Similarly, after a particular connecting or disconnecting operation has been completed, the pipe string can be pulled upwardly a short distance relative to the rotary table and slip bowl, to thus move the slips upwardly out of the bowl. The slips may then be released from their clamped condition, and if desired can be swung laterally to a retracted position at a side of the pipe until the next successive connecting or disconnecting operation is to be performed.

The slips per se may be articulately interconnected as a slip assembly forming at one side a throat through which the well pipe may pass during movement of the assembly between active and retracted positions, with that throat being at least partially closeable when the slips are in their pipe clamping conditions. The power unit for actuating the slips to their clamping condition may be a piston and cylinder mechanism, connected to a pair of opposite side slips of the assembly to actuate them toward and away from one another.

Certain additional features of the invention relate to an automatic control or sequencing system for controlling movement of the slips between their clamping and released conditions. Desirably, once an operator has commenced movement of the slip assembly inwardly toward the well pipe from a retracted position offset to a side of the pipe, the slip assembly, without further manual control, automatically continues its inward advancement to a position about the pipe, and then closes to clamping condition to grip the pipe.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIMENT

Figure 1:
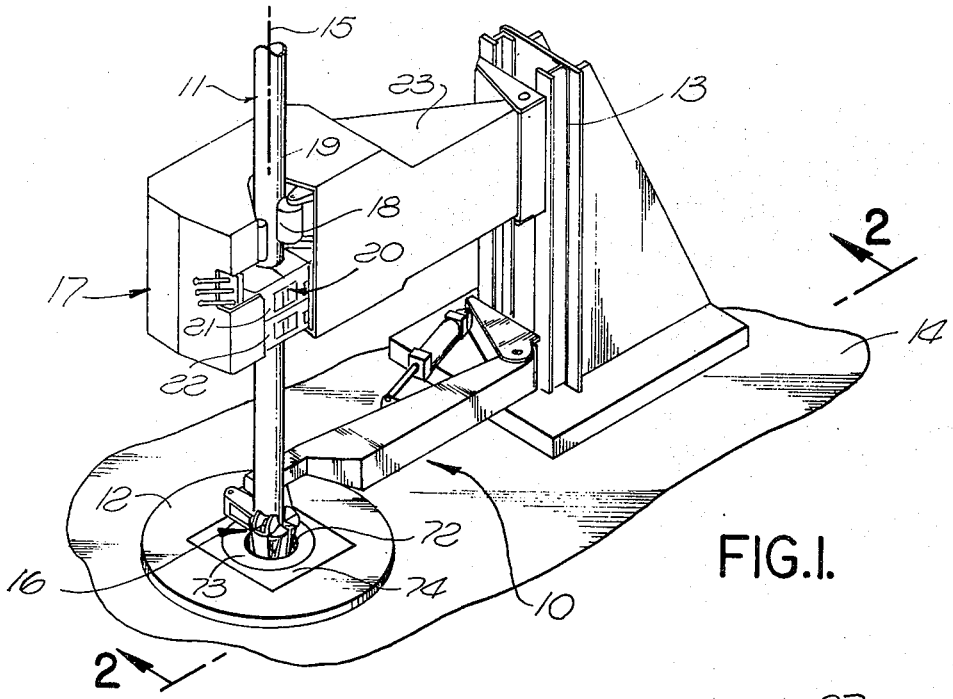
FIG. 1 is a perspective view of a well tool which includes a power slip constructed in accordance with the present invention.

The well tool which is designated generally by the number 10 in FIG. 1 is utilized on a well rig for making and breaking threaded connections in a vertical drill string or other well pipe 11 which extends downwardly through the usual rotary table 12 into the well. Tool 10 includes an upstanding support 13 mounted to the floor 14 of the rig at a location offset to one side of the well pipe 11 and its vertical axis 15. A power slip unit 16 formed in accordance with the present invention is movably mounted to support 13. Above the power slip unit, support 13 carries a pipe turning assembly 17, which includes a spinner 18 for turning an upper joint 19 of the pipe relatively rapidly in making and breaking a connection, and a torque wrench 20 beneath the spinner having upper and lower gripping assemblies 21 and 22 for gripping two successive joints of the pipe and turning them with substantial torque during the final portion of the makeup operation or the initial part of an unthreading operation. The assembly 17 is mounted by an arm 23 to swing laterally between an active position about the pipe and a retracted position offset to a side of the pipe. To permit such swinging movement, the spinner and torque wrench have appropriate openings or gates at one side to pass the drill pipe laterally. The present application is concerned primarily with the structure and method of operation of the power slip unit 16.

Figure 2:
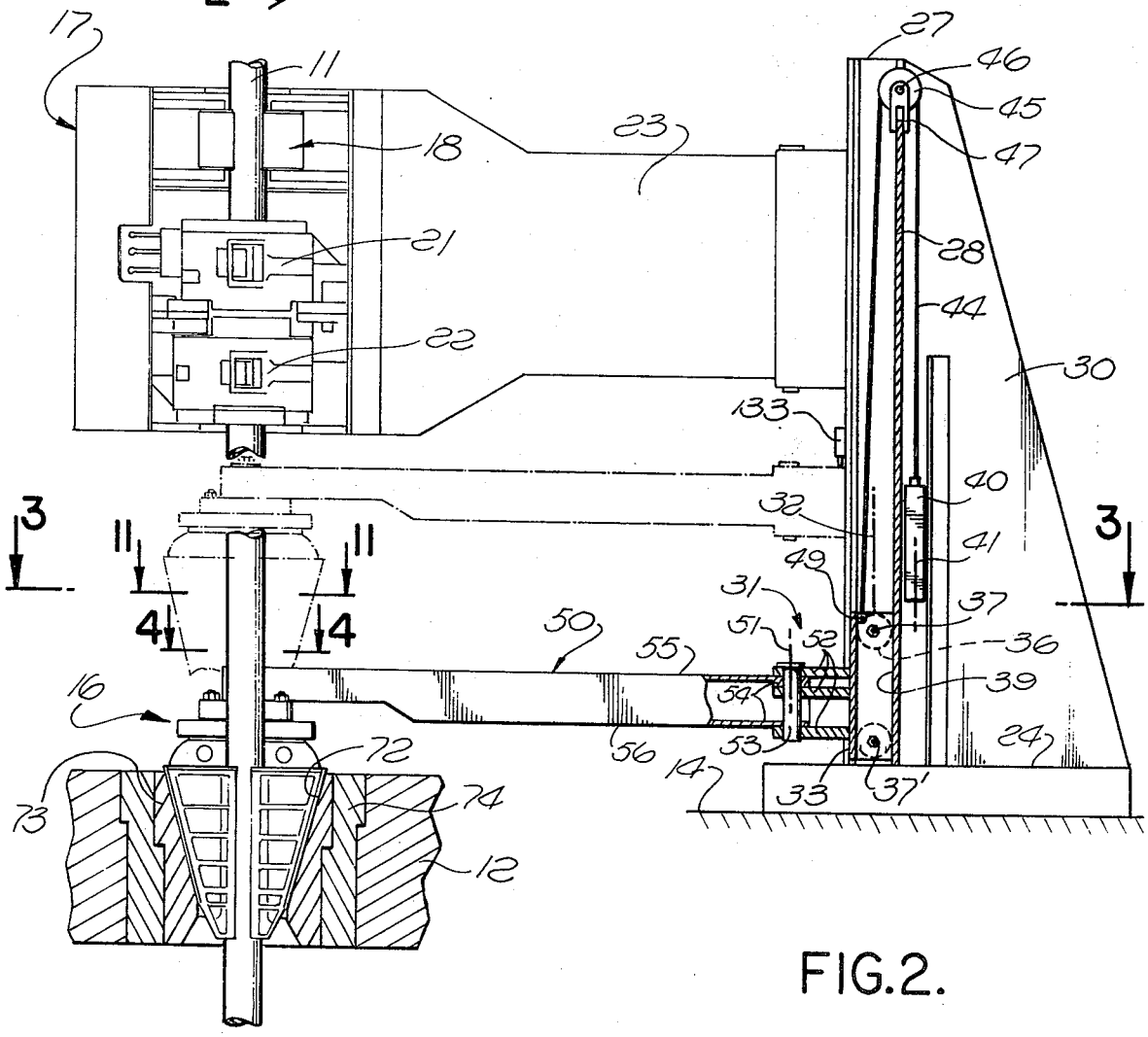
FIG. 2 is an enlarged side view of the power slip of FIG. 1, taken on line 2—2 of FIG. 1.
Figure 3:
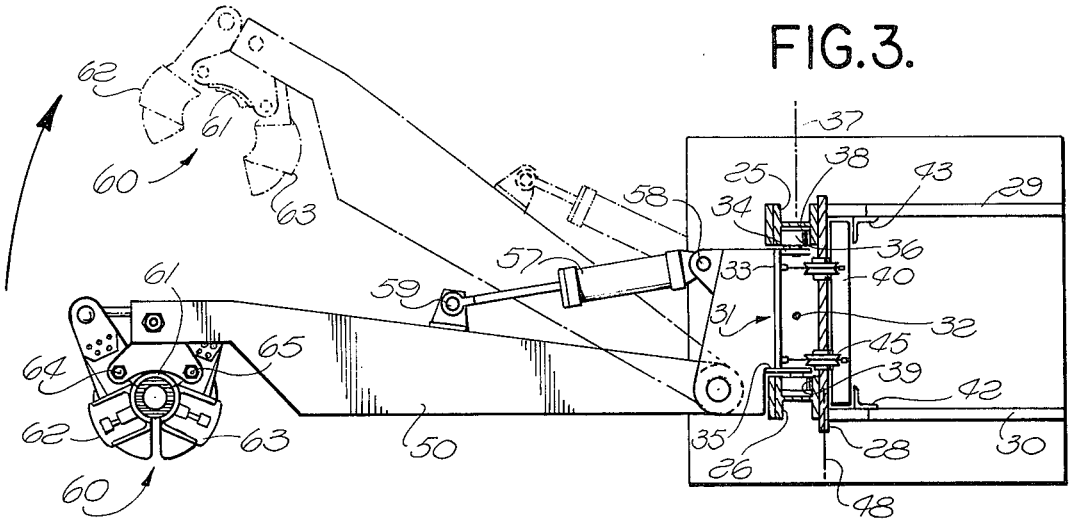
FIG. 3 is a plan view of the power slip taken on line 3—3 of FIG. 2.

The support 13 may include a base plate 24 which is welded, bolted or otherwise rigidly secured to the rig floor, and which carries two similar spaced vertical upwardly projecting track members 25 and 26, which for their entire vertical height from the level of base plate 24 to their upper extremities 27 (FIG. 2) have the H-shaped horizontal cross-section illustrated in FIG. 3. These track members 25 and 26 may be secured together and reinforced at their rear sides by a vertical plate 28 appropriately welded or otherwise secured to the track members, and by spaced parallel vertical rear supporting plates 29 and 30 secured to plate 28.

A carriage 31 is mounted between tracks 25 and 26 for movement upwardly and downwardly along a vertical exis 32 parallel to the main vertical axis 15 of the well. This carriage 31 may include a front vertical plate 33 secured to a pair of parallel opposite side plates 34 and 35 which rotatably carry vertically spaced pairs of rollers 36 turning about horizontal axes 37 and 37'. These rollers are received within vertical guideways 38 and 39 formed at the inner sides of track members 25 and 26, and engage the sidewalls of those guideways in a manner guiding carriage 31 for only the desired vertical movement along axis 32.

The carriage 31 and the remainder of the power slip assembly carried thereby are yieldingly urged upwardly by a counterweight 40, which may be rectangular as shown and be guided for upward and downward movement along a vertical axis 41 parallel to axis 32. This counterweight is slidably received and guided between wall 28 and two vertical angle irons 42 and 43 (FIG. 3) carried by members 29 and 30, with the counterweight being confined laterally by forward portions of the plates 29 and 30. Flexible cables 44 suspend the counterweight, and extend upwardly therefrom and about two pulleys 45 mounted rotatably by a shaft 46 supported by brackets 47 carried by the upper edge of plate 28. These pulleys 45 turn about a horizontal axis 48. After passing about the pulleys, cables 44 extend downwardly to points of connection at 49 (FIG. 2) to the upper edge of carriage 31. The mass of counterweight 40 is sufficient to normally maintain carriage 31 and the entire power slip assembly 16 carried thereby in their upper broken line positions of FIG. 2, in which the entire slip unit is located above the level of the rig floor and is therefore free to swing laterally into and out of engagement with the well pipe.

The slip assembly 16 includes an elongated horizontally extending arm 50 which may be hollow and fabricated of sheet metal top, bottom and side walls cut to give the arm the external shape illustrated in the figures, and welded together along their meeting edges. At one end, this arm is mounted to carriage 31 for horizontal swinging movement between the broken line retracted and full line active positions of FIG. 3, and about a vertical axis 51, relative to the carriage. This pivotal mounting may be attained by providing carriage 31 with three similar vertically spaced horizontal mounting plates 52 (FIG. 2) secured to and projecting forwardly from wall 33 of the carriage, and containing openings through which a vertical pivot pin 53 extends, with the pin also passing through circular openings, in portions 54 of the top and bottom walls 55 and 56 of arm 50. A hydraulically actuated piston and cylinder mechanism 57 swings the arm 50 between its two FIG. 3 positions, and may have its cylinder pivoted to plates 52 at 58, and its piston rod pivoted to arm 50 at 59.

Figure 4:
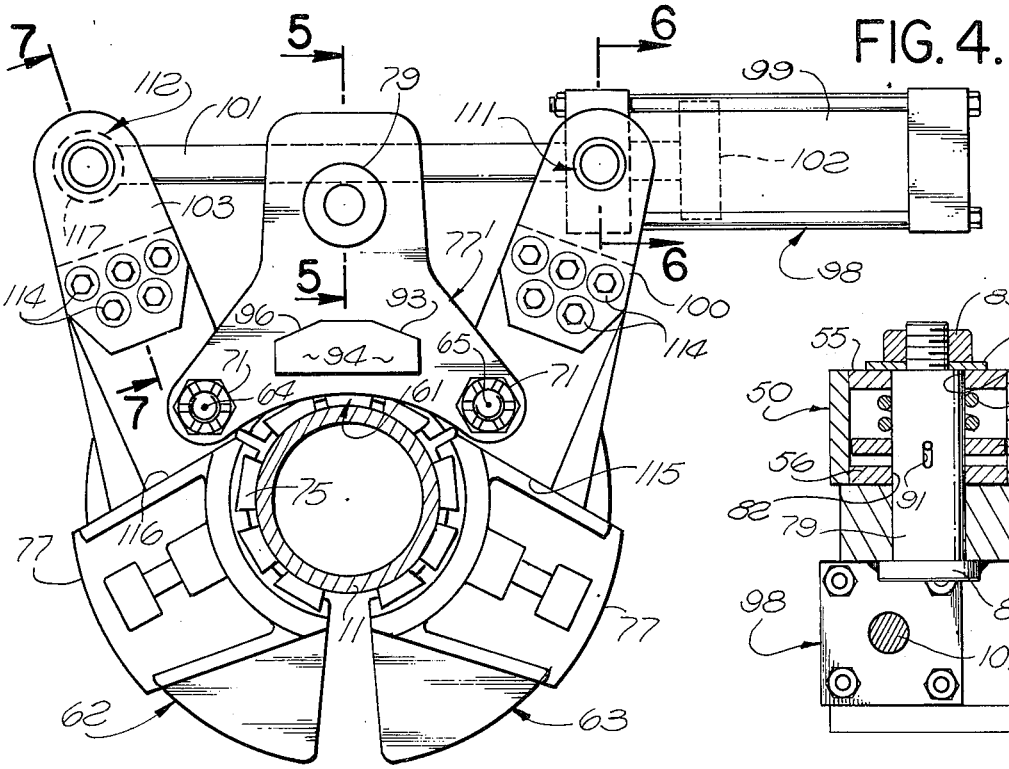
FIG. 4 is an enlarged horizontal section taken on line 4—4 of FIG. 2.
Figure 8:
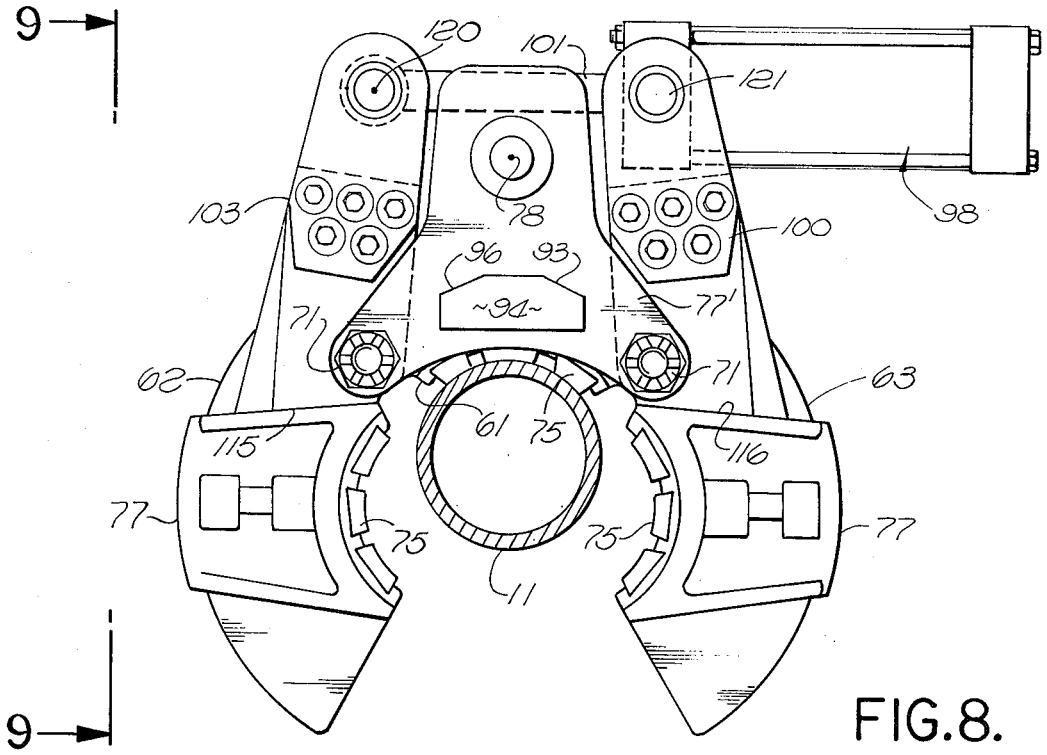
FIG. 8 is a view similar to FIG. 4, but showing the slip assembly in open condition.
Figure 10:
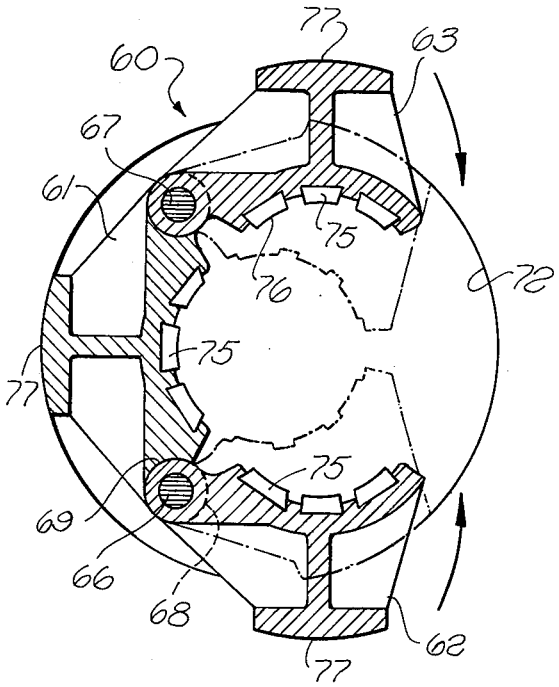
FIG. 10 is a section taken on line 10—10 of FIG. 9.
Figure 9:
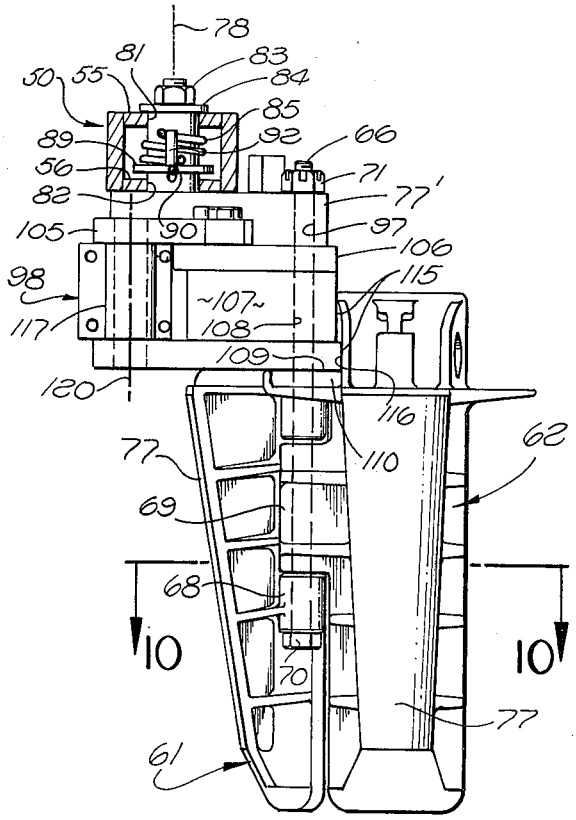
FIG. 9 is a side view of the slip assembly, taken on line 9—9 of FIG. 8.
Figure 11:
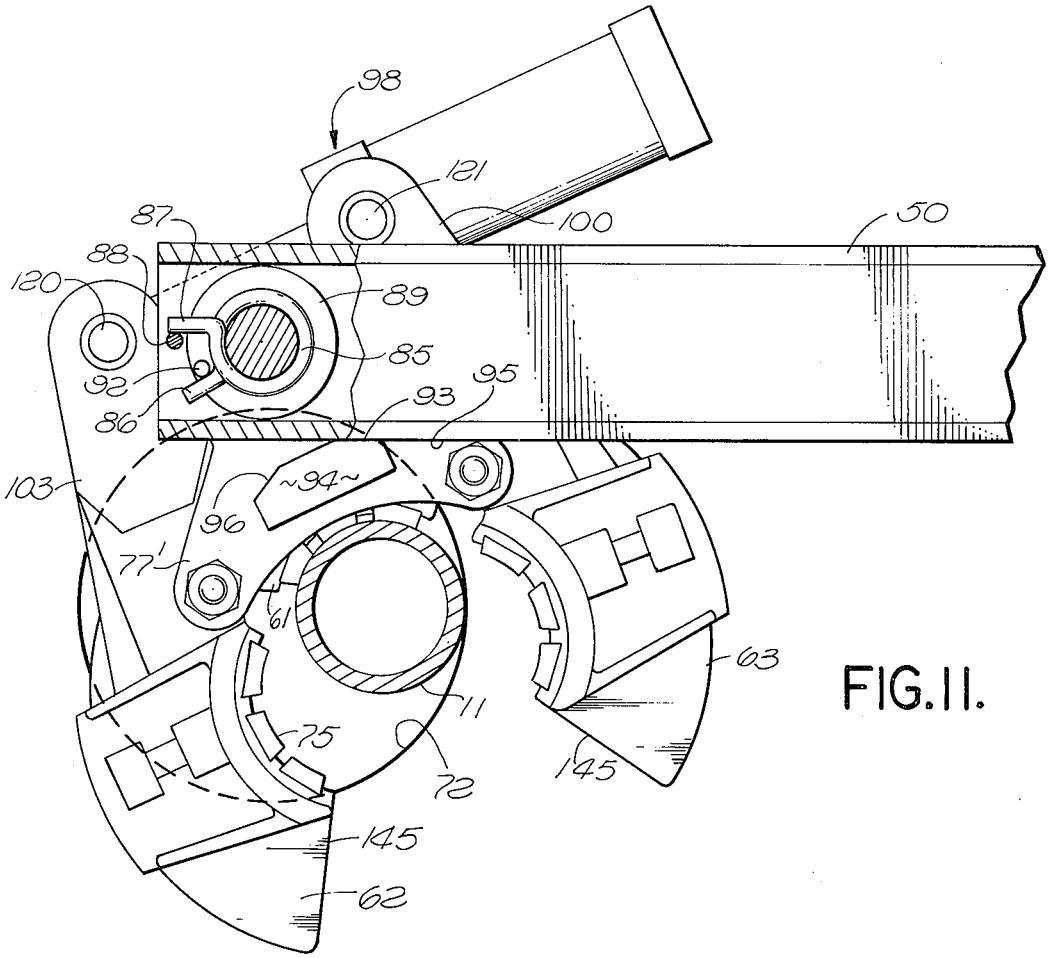
FIG. 11 is a fragmentary plan view, taken primarily on the plane of line 11—11 of FIG. 2, but showing the slips in open condition and deflected laterally for gripping a pipe which is offset to one side of the slip bowl.

At its free end, arm 50 carries a slip assembly 60 preferably including a first central slip 61 and two opposite side slips 62 and 63 pivoted to central slip 61 for relative swinging movement about two parallel vertical axes 64 and 65 between the closed pipe gripping positions of FIGS. 3 and 4 and the open positions of FIGS. 8 and 11. These pivotal connections between the slips are provided by two elongated parallel vertical threaded screws 66 and 67 (FIGS. 8 and 9), each of which extends through a pair of tubular hinge lugs 68 on the center slip 61 and an intermediate tubular hinge lug 69 on one of the side slips 62 or 63, with the hinge screws 66 and 67 being retained by heads 70 at their lower ends and nuts 71 at their upper ends.

The bodies of the three slips are of conventional downwardly tapering wedge-shaped configuration, as shown, to coact with a correspondingly downwardly tapering conical inner surface 72 of a slip bowl 73 supported by a master bushing 74 within the rotary table 12. At their radially inner sides, the three slips carry gripping dies 75 of any conventional type having gripping edges 76 which in the closed FIG. 4 condition of the slips follow essentially the curvature of the outer cylindrical surface of the well pipe, and tightly grip the pipe in a manner preventing relative vertical movement between the pipe and slips. At their radially outer sides, the slips have downwardly conically tapering outer cam surfaces 77 which follow the curvature of and are essentially continuously engageable with slip bowl surface 72 in the closed condition of the slips, to cam the slips inwardly against the pipe in response to exertion of downward force, and thereby support the weight of the pipe from the rotary table in the usual manner.

Figure 5:
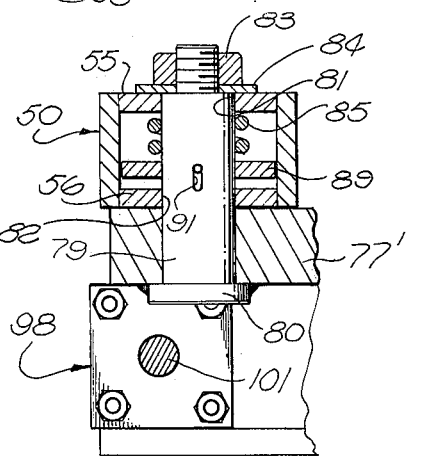
FIG. 5, 6 and 7 are fragmentary vertical sections taken on lines 5—5, 6—6 and 7—7 respectively of FIG. 4.

In order to allow the three slips to turn together through a limited range of movement and to a position such as that shown in FIG. 11 relative to the mounting arm 50, all three of the slips are carried by a mounting part 77' which is connected to arm 50 for pivotal movement relative to the arm about a vertical axis 78. The pivotal connection between these parts includes an externally cylindrical pivot pin 79 (FIG. 5) having a head 80 which is welded to part 77', with the cylindrical shank of the pin projecting upwardly through that part and upwardly thereabove and being journalled rotatably within circular openings 81 and 82 in top and bottom walls 55 and 56 of arm 50. A nut 83 threadedly connected onto the upper end of pivot pin 79 may act downwardly against top wall 55 of arm 50 through a washer 84 to support the pin and slip assembly from the arm. A coil spring 85 disposed about pin 79 at a location within the hollow arm 50 has two outwardly turned arms 86 and 87 (FIG. 11) at its opposite ends which are normally in engagement with opposite sides of an upstanding pin 88 carried by arm 50, to yieldingly hold part 77' and the carried slips in the central position illustrated in FIG. 4 and 8. The pivot pin 79 carries a ring 89 (FIG. 9), which is secured against rotation relative to pin 79 by a set screw or lock pin 90 extending into a slot or opening 91 in pin 79. The ring 89 rigidly carries an upwardly projecting pin or post 92 which is normally received in alignment with and adjacent the pin 88, and which upon turning movement of part 77' about axis 78 relative to arm 50 acts against one or the other of the spring ends 86 or 87 to move that spring end circularly about axis 78 relative to the other end of the spring. For example, in FIG. 11, pin 92 has moved the spring end 86 in a counterclockwise direction relative to the spring end 87, so that the spring yieldingly resists the turning movement of part 77' from its FIG. 4 centered position to its FIG. 11 position, at which setting the turning movement of part 77' and the carried slips is limited by engagement of a shoulder 93 on a part 94 carried by member 77' with a side surface 95 of arm 50. Similarly, swinging movement of part 77' in the opposite direction is limited by engagement of a shoulder 96 on part 94 with the side surface 95 or arm 50.

The center slip 61 is held in fixed position relative to and substantially directly beneath the carrier part 77' by extension of the previously discussed slip hinge screws 66 and 67 through the hinge lugs 68 at the opposite sides of slip 61 and also through vertical openings 97 (FIG. 9) in part 77'.

Figure 7:
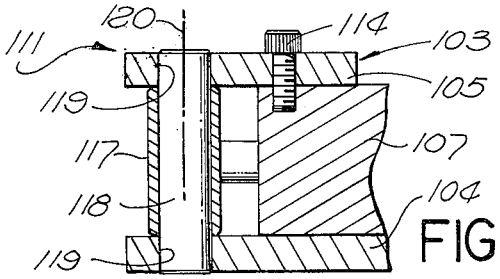

The two side slips 62 and 63 are power actuated between their open and closed conditions of FIGS. 8 and 4 respectively, and are urged in a closing direction beyond the FIG. 4 condition to tightly grip and clamp inwardly against the pipe, by a fluid actuated piston and cylinder mechanism 98, whose cylinder 99 is pivotally connected at 111 to a clamping arm 100 secured to slip 63, and whose piston rod 101 projecting from piston 102 is pivotally connected at 112 to a clamping arm 103 secured to slip 62. As seen best in FIGS. 7 and 9, the clamping arm 103 may be formed sectionally of a lower essentially horizontal plate 104, two upper plates 105 and 106, and an intermediate block 107, all rigidly secured together in appropriate manner as by a number of screws 114 extending downwardly through these various parts, with parts 104, 106, and 107 containing aligned apertures 108 through which hinge pin 66 extends, and with parts 104, 106 and 107 being confined vertically between part 77' and an upwardly facing surface 109 formed on a flange 110 projecting laterally from and carried by slip 62. The parts 104 and 107 have shoulders 115 which bear against a side surface 116 formed on the top portion of slip 62 in a relation effectively transmitting clamping force from arm 103 to that slip. In addition, arm 103 may be suitably rigidly connected to slip 62 to transmit swinging movement in both directions from the arm to the slip, as by welding these parts together or otherwise interconnecting them.

The pivotal connection 112 between piston rod 101 and clamping arm 103 may be formed by providing the end of the rod with a tubular vertically extending portion 117 received and confined between plates 104 and 105, and disposed about a vertical pivot pin 118 which is retained at its upper and lower ends within openings 119 in plates 104 and 105. The pivotal axis 120 of this connection between the piston rod and arm 103 extends vertically and parallel to the pipe axis.

Figure 6:
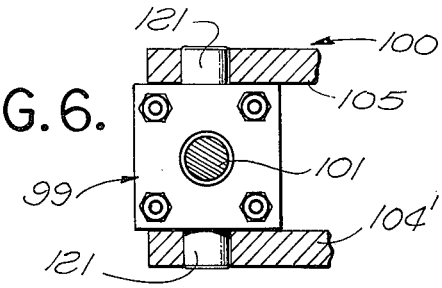

The other clamping arm 100 is formed sectionally in the same manner as arm 103, except that arm 100 is a mirror image of arm 103 to properly engage and be connected to the oppositely directed side slip 63. The pivotal connection 111 between cylinder 99 and arm 100 may be formed by providing the cylinder with upper and lower trunion shafts 121 (FIG. 6) journaled within openings formed in upper and lower plates 105' and 104' of arm 100 corresponding to upper and lower plates 105 and 104 of arm 103.

Figure 12:
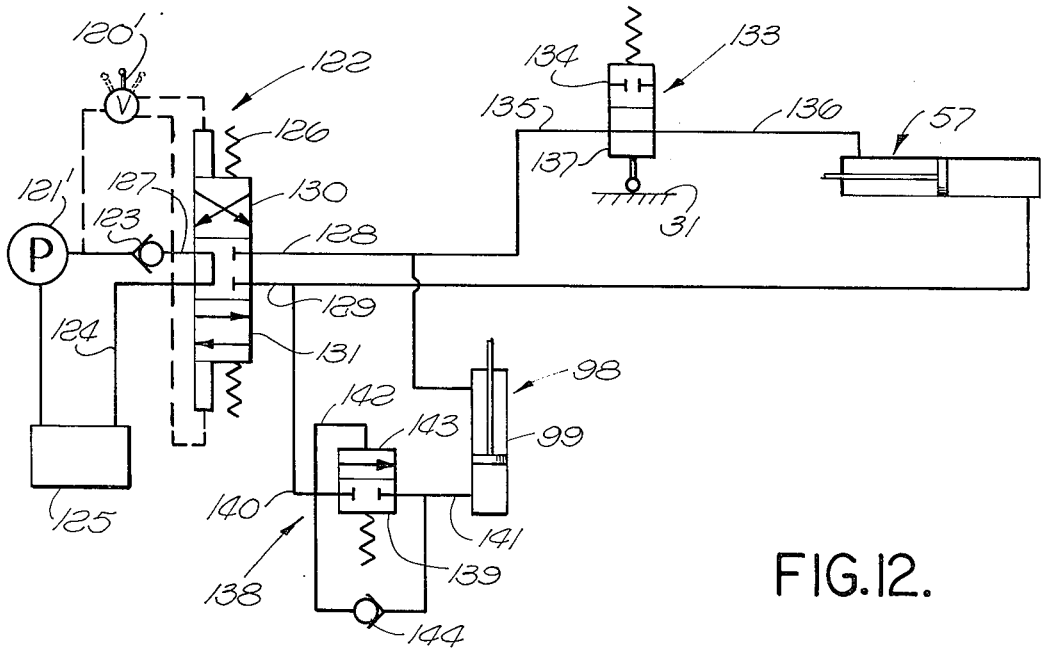
FIG. 12 is a schematic representation of the hydraulic system of the slip.

Referring to FIG. 12, the hydraulic system for controlling actuation of the slip unit 16 includes a three position manually actuated valve 120' which receives pressure fluid from a main hydraulic supply pump 121' and controls the delivery of pilot presures to a second three position hydraulic valve 122. Pump 121' delivers pressurized fluid to valve 122 through a check valve 123, with the return line 124 from valve 122 leading to an accumulation tank 125 from which the pump takes suction.

The diagrammatically represented main valve 122 is yieldingly urged by springs 126 to the closed position in which the valve is shown in FIG. 12. In that position, the pressurized fluid from pump 121' is directed by valve 122 into return line 124, without delivery of any of the pressurized fluid to either of the lines 128 or 129 at the discharge side of valve 122. When valve 120' is actuated from its neutral or closed condition to a second of its settings, the pilot pressures thus delivered to valve 122 actuate that valve downwardly as viewed in FIG. 12 so that the upper section of the valve diagrammatically represented at 130 places line 127 in communication with line 129, and places line 124 in communication with line 128. Similarly, in an opposite or third position of valve 120', the pilot pressures actuate the body of valve 122 upwardly so that the lower section 131 of the valve places line 127 in communication with line 128, and places line 124 in communication with line 129.

Line 128 is connected by a line 132 to the rod end of clamping cylinder 99, and is connected through a valve 133 to the rod end of piston and cylinder mechanism 57 which swings the slip carrying arm between active and retracted positions. This valve 133 is adapted to automatically respond to movement of the slip carrying mechanism to its uppermost position in which the slips are high enough to be located entirely above the level of the rotary table and slip bowl structure, so that the slip mechanism can be safely swung horizontally between its active and inactive positions. For example, the valve 133 may typically be positioned as shown in FIG. 2, to be engageable by a portion of carriage 33 (such as one of the plates 52) when the carriage reaches its uppermost position. As represented diagrammatically in FIG. 12, the movable part of valve 133 may be spring urged downwardly to a position in which an upper section 134 of that valve closes off communication between two lines 135 and 136 communicating with valve 122 and mechanism 57 respectively. When the valve is actuated upwardly by arrival of the slips in their uppermost position, a lower section 137 of valve 133 then becomes effective to place lines 135 and 136 in communication.

Pressure fluid for actuating the clamping cylinder mechanism 98 is delivered to that mechanism from line 129 through another automatic valve 138, which as diagrammatically represented is spring urged upwardly to a position in which its lower section 139 closes off communication between two lines 140 and 141. Upon a predetermined increase in pressure in line 140, communicated through a line 142, the valve is actuated downwardly to a position in which its upper section 143 places lines 140 and 141 in communication. A check valve 144 allows flow from line 141 to line 140 upon unclamping actuation of piston and cylinder mechanism 98.

To describe a cycle of use of the power slip, assume that arm 50 and the carried slip assembly are initially in their retracted or inactive positions in which the slips are offset to a side of the well (broken lines in FIG. 3). When it is desired to actuate the slips to grip and support a well pipe, the operator actuates valve 120' from its neutral position to a second position, to correspondingly move pilot controlled valve 122 to a position in which its upper section 130 delivers pressurized fluid to line 129, and through that line to the swing cylinder 57, thereby causing that cylinder to commence swinging movement of arm 50 and the carried slips from their broken line positions of FIG. 3 inwardly toward the well pipe and the full line positions of FIG. 3. Pressure is simultaneously delivered through line 140 to valve 138, but that pressure is insufficient to actuate the valve downwardly against its adjusted spring resistance far enough to pass the pressurized fluid to cylinder 98. When the slips reach a position in which the center one of the slips 61 engage the pipe, this engagement prevents further movement of slip 61 and arm 50, and thereby causes an increase in pressure in swing cylinder 57, which increase in pressure is communicated through lines 140 and 142 to the upper end of valve 138, and actuates that valve downwardly to a position in which its upper section 143 delivers the pressure fluid from line 140 to the lower end of clamping cylinder 98. This pressure causes the clamping cylinder mechanism 98 to force rod 101 of that mechanism outwardly relative to cylinder 99, and thereby clamp slips 62 and 63 toward one another and against the pipe, to the clamped condition of FIG. 4, in which the three slips tightly grip the pipe with a force frictionally locking the slips against upward or downward movement relative to the pipe. The operator then actuates the raising and lowering mechanism of the rig to lower the well pipe far enough to bring the three slips into engagement with slip bowl surface 72, so that the weight of the pipe can thereafter be supported from the slips in conventional manner. When it is desired to release the slips, the rig mechanism is actuated to raise the well pipe and attached slips upwardly from the slip bowl, and valves 120' and 122 are actuated to reversed positions in which pressure fluid is supplied to the rod ends of clamping cylinder 98 and swing cylinder 57, to release the clamping engagement of the slips with the pipe, and swing the slips and their carrying arm laterally to their retracted positions. Counterweight 40 assures full return of the slips to their uppermost positions as soon as the clamping engagement with the pipe is released, and valve 133 prevents delivery of the actuating pressure to swing cylinder 57 until the slips are in their uppermost positions and high enough to move laterally without contacting any portion of the rotary table or its carried parts. During the slip unclamping actuation of piston and cylinder mechanism 98, the pressure fluid is bypassed around valve 138 through check valve 144.

If during the swinging movement of the slips from their retracted to their active positions, the well pipe is off center with respect to the axis of the well and the slip bowl, as represented in FIG. 11, one of the diverging cam surfaces 145 of the two clamping slips 62 and 63 engages the pipe in a relation turning the entire slip assembly about axis 78 relative to part 77 and arm 50 far enough to enable the pipe to enter the slip assembly between the surfaces 145 of the slips. Because of the manner in which clamping cylinder 98 is connected to slips 62 and 63, it also can swing with these slips about axis 78, and can effectively perform its clamping action even though the well pipe is offset from the main well axis.

While a certain specific embodiment of the present invention has been disclosed as typical, the invention is of course not limited to this particular form, but rather is applicable broadly to all such variations as fall within the scope of the appended claims.

I claim:

1. The combination comprising:

a slip assembly including a plurality of relatively movable slips having inner pipe gripping portions and outer downwardly tapering faces adapted to be cammed inwardly by downward movement relative to a coacting tapered bowl; and powered means for releasably clamping said slips inwardly against a generally vertical well pipe by force exerted other than through the camming action of said bowl, and with a force sufficient to releasably lock the slips to the pipe for vertical movement therewith relative to the bowl;

said slips including a central slip and two clamping slips hinged to opposite sides thereof;

said powered means including a piston and cylinder mechanism acting in opposite directions against said two side slips respectively to power actuate them against the pipe.

2. The combination comprising:

a slip assembly including a plurality of relatively movable slips having inner pipe gripping portions and outer downwardly tapering faces adapted to be cammed inwardly by downward movement relative to a coacting tapered bowl;

means mounting said slip assembly for movement laterally between an active position about a well pipe and a retracted position offset to a side of the pipe; and powered means for actuating said slips between an open condition permitting movement of the assembly onto and off of a pipe and a closed condition in which said slips are clamped against the pipe by force exerted other than through the camming action of said bowl;

said mounting means including a part carrying said slip assembly and movable toward and away from said pipe to actuate said assembly between said active and retracted positions, and a connection mounting said assembly to said part for limited turning movement to engage and encircle the pipe even though it may be slightly offset from a predetermined normal axis of the well.

3. The combination as recited in claim 2, including means yieldingly urging said slip assembly to a predetermined centered position within its range of turning movement relative to said part.

4. The combination comprising:

a slip assembly including a plurality of relatively movable slips having inner pipe gripping portions and outer downwardly tapering faces adapted to be cammed inwardly by downward movement relative to a coacting tapered bowl;

means mounting said slip assembly for movement laterally between an active position about a well pipe and a retracted position offset to a side of the pipe; and powered means for actuating said slips between an open condition permitting movement of the assembly onto and off of a pipe and a closed condition in which said slips are clamped against the pipe by force exerted other than through the camming action of said bowl;

said slip assembly including a first slip and two additional slips hinged to opposite sides thereof for swinging movement relative to said first slip to clamp a pipe, said additional slips forming a throat therebetween through which the pipe passes upon movement of said assembly between said active and retracted positions;

said powered means including a piston and cylinder mechanism connected to said two additional slips to actuate them in opposite directions for clamping and releasing the pipe.

5. The combination as recited in claim 4, in which said mounting means include a support to be mounted at a side of said pipe, and an arm carrying said slip assembly and mounted to said support for generally horizontal swinging movement to move said assembly between said positions thereof, there being a pivotal connection between said first slip and said arm mounting said first slip and the carried additional slips for pivotal movement relative to said arm within a predetermined limited range of movement and to opposite sides of a predetermined centered position to enable engagement of the slip assembly with a pipe offset laterally from the axis of the well.

6. The combination as recited in claim 5, including spring means yieldingly urging said first slip to said centered position, and stop means limiting swinging movement of said first slip at the ends of said range of movement.

7. The combination as recited in claim 6, including counterweight means yieldingly urging said arm and carried slip assembly upwardly relative to said support.

8. The combination comprising:

a slip assembly including a plurality of relatively movable slips having inner pipe gripping portions and outer downwardly tapering faces adapted to be cammed inwardly by downward movement relative to a coacting tapered bowl;

means mounting said slip assembly for movement laterally between an active position about a well pipe and a retracted position offset to a side of the pipe, said mounting means including a support at a side of the pipe and an arm carrying said slip assembly and mounted to said support for swinging movement to move said slip assembly between said active and retracted positions;

powered means for actuating said slips between an open condition permitting movement of the assembly onto and off of a pipe and a closed condition in which said slips are clamped against the pipe by force exerted other than through the camming action of said bowl, said powered means including a first fluid operated mechanism for actuating said slips between open and closed conditions;

a second fluid actuated mechanism for swinging said arm between retracted and active positions; and automatic control means responsive to an increase in fluid pressure in said second fluid actuated mechanism resulting from engagement of said slip assembly with a pipe to automatically supply pressure fluid to said first fluid actuated mechanism for moving the slips to their clamping condition.

9. The combination comprising:

a slip assembly including a plurality of relatively movable slips having inner pipe gripping portions and outer downwardly tapering faces adapted to be cammed inwardly by downward movement relative to a coacting tapered bowl;

means mounting said slip assembly for movement laterally between an active position about a well pipe and a retracted position offset to a side of the pipe;

powered means for actuating said slips between an open condition permitting movement of the assembly onto and off of a pipe and closed condition in which said slips are clamped against the pipe by force exerted other than through the camming action of said bowl;

additional powered means for moving said slip assembly between said retracted and active positions; and automatic control means responsive to arrival of said slip assembly at essentially said active position to automatically cause said first mentioned powered means to actuate the slips to clamping condition.

10. The combination as recited in claim 9, in which said first mentioned powered means and said additional powered means are both actuated by pressure fluid, said automatic control means including means responsive to an increase in fluid pressure in said additional powered means resulting from engagement of said slip assembly with a pipe to automatically supply pressure fluid to said first mentioned powered means for moving the slips to their clamping condition.

11. The combination as recited in claim 9, in which said first mentioned powered means and said additional powered means are both actuated by pressure fluid, said automatic control means including first valve means for admitting pressure fluid to said additional powered means to actuate said assembly to said active position, said additional powered means being a piston and cylinder mechanism in which the pressure increases as a result of the resistance offered to further movement of the assembly when the assembly reaches active position, said automatic control means including additional valves means subjected to the pressure of fluid passed to said additional powered means by said first valve means and adapted to remain closed as said assembly is moved toward said active position but to be automatically opened by the increased pressure upon arrival of the assembly at said active position, and to then pass pressure fluid to said first mentioned powered means to clamp said assembly about the pipe.

12. For use with well apparatus including an internally tapered slip bowl structure supported at the upper end of a well at a location to pass a well pipe downwardly through said bowl structure and into the well; the combination comprising:

a supporting structure to be mounted at a side of the well;

a slip assembly mounted to said supporting structure for movement laterally between a retracted position offset to a side of the well and an active position about said pipe, and for movement downwardly and upwardly when in said active position;

said assembly including a plurality of slips interconnected for opening and closing movement relative to one another to pass the assembly laterally onto and off of the pipe;

said slips having lower portions which in said active position are movable downwardly into said bowl structure to a predetermined pipe supporting level therein, and which have outer tapered camming faces and inner pipe gripping faces engageable with said bowl structure and an outer cylindrical surface of the well pipe respectively to support the pipe against downward movement when the slips are at said predetermined level;

power operated means actuated to clamp the slips tightly inwardly against said cylindrical surface of the pipe, while said slips are at an upper level higher than said pipe supporting level, and with a force positively locking said slips to the pipe for movement downwardly therewith to said pipe supporting level; and means for holding said slips elevated at said upper level and above said pipe supporting level while said slips are in said active position about the pipe and are being clamped against the pipe by said power operated means for said downward movement with the pipe.

13. The combination as recited in claim 12, in which said last mentioned means yieldingly urge said slips upwardly toward said upper level and yieldingly resist movement of the slips downwardly to said pipe supporting level.

14. The combination as recited in claim 12, in which said last mentioned means are counterbalancing means yieldingly urging said slips upwardly during movement of said assembly laterally inwardly and outwardly between said active and retracted positions and acting in said active position of the assembly to yieldingly resist movement of the assembly downwardly to said pipe supporting level and tending to urge said slips upwardly to or maintain them at said upper level upon release of said assembly from clamping condition.

15. The combination as recited in claim 12, including said slip bowl structure as an element of the combination.

16. The combination as recited in claim 12, in which said supporting structure is a support column extending generally vertically at a side of the well;

there being a carrier mounted to said column for upward and downward movement relative thereto, and means mounting said slip assembly to said carrier for upward and downward movement therewith and for movement horizontally relative thereto between said active and retracted positions; said last mentioned means of claim 12 being counterbalancing means yieldingly urging said carrier upwardly relative to said column in a relation holding said slip assembly at said upper level during said horizontal movement between retracted and active positions and acting in said active position to yieldingly resist downward movement of said carrier and said assembly between said levels and tending to return them upwardly.

17. The combination as recited in claim 16, including additional power operated means for moving said slip assembly horizontally reltaive to said carrier.

18. The combination as recited in claim 17, in which said slips include a first slip and two additional slips hinged to opposite sides thereof for swinging movement relative to said first slip to clamp a pipe, said additional slips forming a throat therebetween through which the pipe passes upon movement of said assembly between active and retracted positions, said first power operated means including a piston and cylinder mechanism connected to said two additional slips to actuate them in opposite directions for clamping and releasing the pipe, there being a part carrying said slip assembly between said active and retracted positions, a pivotal connection between said part and said first slip mounting said first slip and the carried additional slips for pivotal movement relative to said part within a predetermined limited range of movement and to opposite sides of a predetermined centered position to enable engagement of the slip assembly with a pipe offset laterally from the axis of the well, spring means yieldingly urging said first slip to said centered position, and stop means limiting swinging movement of said first slip at the ends of said range of movement.

19. The combination as recited in claim 12, including additional power operated means for moving said slip assembly horizontally relative to said supporting structure between said active and retracted positions.

20. The combination as recited in claim 19, in which said first mentioned power operated means and said additional power operated means include two piston and cylinder mechanisms operable by pressure fluid to clamp said slips about the pipe and move them between said active and retracted positions.

21. For use with well apparatus including an internally tapered slip bowl structure supported at the upper end of a well at a location to pass a well pipe downwardly through said bowl structure and into the well; the combination comprising:

a supporting structure to be mounted at a side of the well;

a slip assembly mounted to said supporting structure for movement laterally between a retracted position offset to a side of the well and an active position about said pipe, and for movement downwardly and upwardly when in said active position;

said assembly including a plurality of slips interconnected for opening and closing movement relative to one another to pass the assembly laterally onto and off of the pipe;

said slips having lower portions which in said active position are movable downwardly into said bowl structure to a predetermined pipe supporting level therein, and which have outer tapered camming faces and inner pipe gripping faces engageable with said bowl structure and an outer cylindrical surface of the well pipe respectively to support the pipe against downward movement when the slips are at said predetermined level;

power operated means actuable to releasably clamp the slips tightly inwardly against said cylindrical surface of the pipe with a force positively locking said slips to the pipe for movement vertically therewith between said pipe supporting level and an upper level spaced thereabove; and means for yieldingly urging said slip assembly upwardly toward said upper level by force exerted other than through said pipe as said power operated means release said slips from clamping condition and while the slips are still essentially about the pipe.

22. For use with well apparatus including an internally tapered slip bowl structure supported at the upper end of a well at a location to pass a well pipe downwardly through said bowl structure and into the well; the combination comprising:

a supporting structure to be mounted at a side of the well;

a slip assembly mounted to said supporting structure for movement laterally between a retracted position offset to a side of the well and an active position about said pipe, and for movement downwardly and upwardly when in said active position;

said assembly including a plurality of slips which are power actuable to tightly clamp the pipe by force exerted other than through the camming action of said bowl structure;

said slips having lower portions which in said active position are movable downwardly into said bowl structure to a predetermined pipe supporting level therein, and which have outer tapered camming faces and inner pipe gripping faces engageable with said bowl structure and an outer cylindrical surface of the well pipe respectively to support the pipe against downward movement when the slips are at said predetermined level;

means for holding said assembly at an upper level above said pipe supporting level and above said slip bowl structure as said assembly is moved laterally between said active and released positions;

power operated means for moving said assembly laterally between said active and released positions; and automatic control means for preventing movement of said assembly between said active and released positions by said power operated means unless said assembly is at said upper level.

23. The combination as recited in claim 22, in which said power operated means are actuable by pressure fluid to move said assembly laterally, said automatic control means including a valve actuable in response to movement of said assembly to said upper level and acting when so actuated to permit flow of actuating fluid to said power operated means.

24. The method of setting a slip assembly including a plurality of slips which have outer tapered camming faces and inner faces with pipe gripping edges engageable respectively with a tapered bowl and an outer cylindrical surface of a well pipe to support the pipe in a predetermined lower position of the slips, said method comprising:

moving said slip assembly to an upper position about the pipe but spaced substantially above said lower pipe supporting position;

clamping said gripping edges of said inner faces of the slips tightly inwardly against said cylindrical outer surface of the pipe while the slips are in said upper position;

supporting said slips in said upper position by force exerted other than through said bowl as said slips are being clamped against the pipe;

then moving the pipe downwardly while said slips remain clamped tightly thereagainst; and thereby moving said slips downwardly from said upper position to said lower pipe supporting position and into camming pipe supporting engagement with said bowl by force transmitted from said outer cylindrical surface of the pipe to said gripping edges on said inner faces of the slips.

25. The method as recited in claim 24, including holding said slip assembly entirely above the level of said bowl and out of engagement therewith as said slips are clamped tightly against the pipe prior to said downward movement of the pipe.

26. The method as recited in claim 24, including returning said slips upwardly to said upper position thereof by upward movement of the pipe while said slips remain clamped thereto and by force transmitted to the slips through said cylindrical surface of the pipe.

* * * * *